US007234790B2

(12) United States Patent
Kato

(10) Patent No.: US 7,234,790 B2
(45) Date of Patent: Jun. 26, 2007

(54) INK JET RECORDING APPARATUS

(75) Inventor: Yasuhiro Kato, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 225 days.

(21) Appl. No.: 11/131,030

(22) Filed: May 16, 2005

(65) Prior Publication Data

US 2005/0253883 A1 Nov. 17, 2005

(30) Foreign Application Priority Data

May 14, 2004 (JP) ..... 2004-145118

(51) Int. Cl.
*B41J 29/38* (2006.01)

(52) U.S. Cl. ..... 347/12; 347/58

(58) Field of Classification Search ..... 347/12, 347/58, 57, 59, 50, 148, 162, 10, 237, 247
See application file for complete search history.

(56) References Cited

U.S. PATENT DOCUMENTS 5,896,146 A 4/1999 Murata et al.
6,905,185 B2 * 6/2005 Nakayama ..... 347/12
6,945,622 B2 * 9/2005 Sakurai ..... 347/5
6,997,533 B2 * 2/2006 Nakajima et al. ..... 347/9

FOREIGN PATENT DOCUMENTS

JP 08-258292 10/1996

* cited by examiner

*Primary Examiner*—Lamson Nguyen
(74) *Attorney, Agent, or Firm*—Reed Smith LLP

(57) ABSTRACT

The present invention provides an ink jet recording apparatus having high printing quality, in which each nozzle array is driven using a plurality of driver ICs. Assuming that the input terminal nozzles Y (n-3), M (n-2), C (n-1), and Bkn of four actuators form a group n, a group 4 (G4) is formed from input terminals spanning four stages, i.e. Y1, M2, C3, Bk4, and from a group 5 onward, similar groups are formed repeatedly. Input terminals of different colors are connected in succession to a driver IC 26*a* according to a color cycle of C→Y→Bk→M. Meanwhile, input terminals of different colors are connected in succession to a driver IC 26*b* according to a color cycle of Bk→M→C→Y. In all of the nozzle arrays, the driver ICs which drive the nozzles are connected alternately in staggered form.

12 Claims, 16 Drawing Sheets

FIG. 6

CONNECTIONS BETWEEN DRIVER ICs AND ACTUATOR INPUT TERMINALS

| | 1 | 2 | 3 | 4 | ・・・・・・・・・・ |
|---|---|---|---|---|---|
| Y | a 1 | b 2 | a 5 | b 6 | |
| M | a 4 | b 3 | a 8 | b 7 | |
| C | a 2 | b 1 | a 6 | b 5 | |
| B k | a 3 | b 4 | a 7 | b 8 | |

FIG. 10

CONNECTIONS BETWEEN DRIVER ICs AND ACTUATOR INPUT TEMINALS

| | 1 | 2 | 3 | ・・・・・・・・・・ |
|---|---|---|---|---|
| Y | a 1 | b 3 | a 5 | |
| M | a 2 | b 4 | a 6 | |
| C | b 1 | a 3 | b 5 | |
| B k | b 2 | a 4 | b 6 | |

FIG.12

CONNECTIONS BETWEEN DRIVER ICs AND ACTUATOR INPUT TERMINALS

| | 1 | 2 | 3 | 4 | ・・・・・・・・・・・ |
|---|---|---|---|---|---|
| Y | a 2 | b 5 | a 6 | b 9 | |
| M | b 2 | a 4 | b 6 | a 8 | |
| C | b 1 | a 3 | b 4 | a 7 | |
| B k | a 1 | b 3 | a 5 | b 7 | |

FIG. 14

CONNECTIONS BETWEEN DRIVER ICs AND ACTUATOR INPUT TERMINALS

| | 1 | 2 | 3 | 4 | 5 | ・・・・・・・・・・ |
|---|---|---|---|---|---|---|
| Y | a 3 | b 7 | a 7 | b 1 1 | a 1 1 | |
| M | b 3 | a 6 | b 6 | a 1 0 | b 1 0 | |
| C | a 2 | b 2 | a 5 | b 5 | a 9 | |
| B k | b 1 | a 1 | b 4 | a 4 | b 8 | |

INK JET RECORDING APPARATUS

BACKGROUND OF THE INVENTION

1. Field of the Invention

The present invention relates to an ink jet recording apparatus which performs recording by discharging ink from nozzles onto a recording medium.

2. Description of the Related Art

Conventionally, this type of ink jet recording apparatus performs recording by driving an electromechanical transducing element such as a piezoelectric element or an actuator such as an electrothermal transducing element, thereby varying the pressure inside a pressure chamber connected to a nozzle such that ink in the pressure chamber is discharged from the nozzle onto a recording medium.

In recent years, there has been a tendency toward an increased number of nozzles and higher nozzle density in ink jet recording apparatuses in order to achieve higher recording quality. In such ink jet recording apparatuses, either the driver IC is enlarged or a plurality of driver ICs is provided to correspond to the increased number of nozzles. When the driver IC is enlarged, an expensive IC must be used due to low yield and so on, which is disadvantageous in terms of cost. In response to this, Japanese Patent Application Laid-open No. H8-258292 (see FIGS. 6 and 9) enables high-speed recording output by driving a plurality of independent decoders independently.

However, the use of a plurality of decoders is problematic. Particularly in terms of cost reduction, when driver ICs installed with an amp circuit having no feedback control are used, differences may arise among the driver ICs in the ON resistance (resistance in a conductive state) of the amp circuits, and at the same time variation may exist in the output current, output waveform, and other output characteristics of the driver ICs. For example, when a single nozzle array is divided into two groups and driving is performed using one driver IC for each group, differences in the ink droplet speed and ink droplet volume between the groups during discharge lead to tonal variation, printing deviation, and so on between the groups, causing so-called banding, in which a band-form boundary is formed between the groups.

FIG. 8 is a schematic view illustrating the printing condition when an actuator is driven using two driver ICs having different output characteristics. For example, a nozzle array 83 of a head 81 comprises nozzles N1 to N12. The upper nozzles N1 to N6 are connected to a driver IC 80*a*, and the lower nozzles N7 to N12 are connected to a driver IC 80*b*. The two driver ICs 80*a* and 80*b* have different output characteristics, and according to these output characteristics, the driver IC 80*a* has a tendency toward small droplet volume and early discharge timing, whereas the driver IC 80*b* has a tendency toward large droplet volume and late discharge timing. When a recording medium moves relative to the head 81 in a direction shown by an arrow X in FIG. 8, the nozzle array N1 to N6, driven by the driver IC 80*a*, produces a printing condition in which the dot diameter is small, as shown by a dot array 82*a*, and the nozzle array N7 to N12, driven by the driver IC 80*b*, produces a printing condition in which the dot diameter is large and the dots are deviated from the dot array 82*a* in the opposite direction to the arrow X in FIG. 8, as shown by a dot array 82*b*. In other words, the upper half of the printing area is printed palely, whereas the lower half is printed deeply, and hence a difference in the halftones of the color occurs. Moreover, since the discharge timing of the two driver ICs is different, printing deviation also occurs. Note that each of the dot arrays 82*a*, 82*b* occupies a substantially identical area. These differences in printing condition between wide areas such as the upper half and lower half of the printing area lead to the occurrence in the printing area of the aforementioned banding phenomenon.

To avoid this phenomenon, the individual output characteristics of the driver ICs must be matched between themselves. Methods which may be considered for this purpose include:

(1) measuring the output characteristics of driver ICs one by one and combining those having close characteristics; and (2) selecting driver ICs manufactured in adjacent sites on a wafer.

However, both of these methods are laborious and expensive, and therefore not practical.

SUMMARY OF THE INVENTION

It is therefore an object of the present invention to realize an ink jet recording apparatus with high recording quality, comprising a plurality of drive circuits for driving an actuator.

According to one aspect of the present invention, which has achieved the above object, there is provided an ink jet recording apparatus comprising:

a head main body having a nozzle array in which a plurality of nozzles for discharging ink onto a recording medium are arranged;

a plurality of actuators provided respectively for each of said nozzles, for discharging ink from said nozzles; and a plurality of drive circuits for outputting to said actuators a driving signal based on print data to cause ink to be discharged from said nozzles, wherein said drive circuits comprise a plurality of individual amp circuits connected individually to each of said actuators in order to switch said actuators between either one of a conductive state and a non-conductive state in accordance with said print data, whereby in said conductive state, said driving signal is outputted to said corresponding actuator via a unique individual resistance of said drive circuit, said plurality of nozzles is distributed among a greater number of groups than the number of said drive circuits, and from among adjacent groups, the actuators corresponding to the nozzles belonging to one of said adjacent groups connect to said individual amp circuits belonging to one of said drive circuits, and the actuators corresponding to the nozzles belonging to the other of said adjacent groups connect to said individual amp circuits belonging to another of said drive circuits.

The aforementioned banding becomes more noticeable in the printing area thereof as the number of groups driven by drive circuits with uniform output characteristics decreases and as the intervals between the bandings become wider. In a conventional case, for example, when two drive circuits are provided and adjacent nozzles are divided along the center into two groups, which is the same number as the number of drive circuits, there is only one boundary between the groups, and hence the banding which occurs on either side of this boundary is extremely noticeable.

According to the present invention, however, the plurality of nozzles are distributed among a larger number of groups (three or more, for example) than the number of drive circuits. Hence the number of boundaries between the groups can be increased and the intervals between the boundaries can be narrowed in comparison with a conventional case.

Accordingly, printing can be performed such that banding is less noticeable than in a conventional case, and thus an ink jet recording apparatus with a high recording quality can be realized.

In the present invention, it is preferable that the nozzles of the nozzle array are distributed among the groups in a unit of the predetermined number of nozzle.

When the nozzles are distributed among the groups in a unit of the predetermined number of nozzele, or in other words in an extremely small unit that can be expressed as the number of nozzles, even if bandings occur between the groups, the intervals between the bandings are extremely narrow, making it difficult to recognize the bandings individually. As a result, it is impossible to recognize the existence of the bandings, enabling a further improvement in the recording quality.

In the present invention, it is also preferable that the number of drive circuits is two, and the nozzles of the nozzle array are distributed among the groups in a unit of the number of nozzle being one.

When the nozzles are distributed among the groups per nozzle, or in other words by the smallest possible unit, the print span of a single group is as narrow as possible.

Hence, even when banding occurs in the parts corresponding to the boundaries between the groups, it is impossible for the naked eye to recognize the existence of the banding, and therefore the recording quality can be improved even further.

Moreover, the number of drive circuits can be suppressed to the minimum required number, i.e. two, enabling a reduction in the manufacturing cost of the ink jet recording apparatus.

In the present invention, it is also preferable that a plurality of nozzle arrays is provided, and a predetermined number of the plurality of nozzle arrays discharges ink of different colors.

When variation exists among the drive circuits of an ink jet recording apparatus for performing so-called color printing, in which a plurality of nozzle arrays is provided and a predetermined number of the plurality of nozzle arrays discharges ink of different colors, banding may occur in each color. For example, when banding occurs in an ink jet recording apparatus which performs printing using ink of four colors, yellow, magenta, cyan, and black, the banding is not noticeable in the printing area printed in yellow, but is noticeable in the printing area printed in black, and hence the recording quality of the entire printing area decreases.

However, by applying the present invention to such an ink jet recording apparatus for performing color printing, the banding can be made unnoticeable, and hence the recording quality can be improved.

According to another aspect of The present invention, there is further provided an ink jet recording apparatus comprising:

a head main body comprising a plurality of nozzle arrays formed with a plurality of nozzles for discharging ink onto a conveyed recording medium, in which said plurality of nozzles are arranged in parallel;

a plurality of actuators provided respectively for each of said nozzles, for discharging ink from said nozzles; and a plurality of drive circuits for outputting a driving signal to said actuators to cause ink to be discharged from said nozzles, wherein said plurality of nozzles are distributed among a greater number of groups than the number of said drive circuits in at least an arrangement direction of said nozzles, and from among adjacent groups, the actuators corresponding to the nozzles belonging to one of said adjacent groups connect to one of said drive circuits, and the actuators corresponding to the nozzles belonging to the other of said adjacent groups connect to another of said drive circuits.

Decreases in recording quality due to banding also arise in an ink jet recording apparatus having a plurality of parallel nozzle arrays, in which the plurality of nozzles in each nozzle array is distributed among a plurality of groups over the arrangement direction of the nozzles, and one drive circuit is provided for each group.

According to the present invention, however, the plurality of nozzles is distributed among a greater number of groups (three or more, for example) than the number of drive circuits. Hence the number of boundaries between the groups can be increased and the intervals between the boundaries can be narrowed in comparison with a conventional case.

Accordingly, printing can be performed such that banding is less noticeable than in a conventional case, and thus an ink jet recording apparatus with a high recording quality can be realized.

In the present invention, it is preferable that the number of the plurality of nozzles belonging to each group is equal to or fewer than the number of the plurality of nozzle arrays.

When the number of nozzles belonging to each group is equal to or lower than the number of nozzle arrays (for example, four nozzles or less when there are four nozzle arrays), the plurality of nozzles can be distributed among an extremely large number of groups, and hence the intervals between the bandings that occurs in the parts corresponding to the boundaries between the groups can be made extremely narrow.

As a result, printing can be performed such that the banding is even less noticeable, and an ink jet recording apparatus with an even higher recording quality can be realized.

In the present invention, it is also preferable that the plurality of nozzles belonging to each group is constituted of nozzles which all belong to different nozzle arrays.

When the plurality of nozzles belonging to each group is constituted of nozzles which all belong to different nozzle arrays, in other words, each group is formed from nozzles existing in the arrangement direction of the nozzle arrays, each group is formed in nozzle units in the nozzle arrangement direction.

Thus, even if banding occurs in the parts corresponding to the boundaries between the groups, the intervals between the bandings is no more than a nozzle unit, and it is therefore impossible to recognize the banding. As a result, a further improvement in recording quality can be achieved.

In the present invention, it is also preferable that the groups are constituted such that the plurality of nozzles are distributed over the arrangement direction of the nozzles and a direction which intersects this arrangement direction.

When the nozzle groups are constituted such that the plurality of nozzles are distributed over the arrangement direction of the nozzles and a direction which intersects the arrangement direction, the printing area printed by the nozzles within a group can be dispersed over the arrangement direction of the nozzles and a direction intersecting the arrangement direction.

Hence, even if banding occurs in the parts corresponding to the boundaries between the groups, the banding is not formed in a linear fashion, and it is therefore difficult to recognize the existence of the banding. As a result, a further improvement in recording quality can be achieved.

In the present invention, it is also preferable that the ink jet recording apparatus comprises a carriage on which the head main body is mounted detachably, wherein the plurality of nozzles is arranged parallel to the conveyance direction of the recording medium, and the carriage performs a reciprocating motion in an orthogonal direction to the conveyance direction in accordance with the driving signal outputted to the actuator.

Decreases in recording quality due to banding also arise in the ink jet recording apparatus, comprising a carriage on which the head main body is mounted detachably, in which the plurality of nozzles are arranged parallel to the conveyance direction of the recording medium, and the carriage performs a reciprocating motion in an orthogonal direction to the conveyance direction in accordance with the driving signal outputted to the actuators.

However, by applying the ink jet recording apparatus of the present invention to such an ink jet recording apparatus, printing can be performed such that the banding is unnoticeable, and hence an ink jet recording apparatus with high recording quality can be realized.

In the present invention, it is also preferable that the plurality of nozzles is arranged in an orthogonal direction to the conveyance direction of the recording medium, and the recording medium is conveyed in accordance with the driving signal.

Decreases in recording quality due to banding also arise in the ink jet recording apparatus of the present invention, in which the plurality of nozzles are arranged in an orthogonal direction to the conveyance direction of the recording medium, and the recording medium is conveyed in accordance with the driving signal.

However, by applying the present invention to such an ink jet recording apparatus, printing can be performed such that the banding is unnoticeable, and hence an ink jet recording apparatus with high recording quality can be realized.

In the present invention, it is also preferable that the number of drive circuits for outputting the driving signal is two.

According to the ink jet recording apparatus of the present invention, the number of drive circuits can be suppressed to the minimum required number, i.e. two, enabling a reduction in the manufacturing cost of the ink jet recording apparatus.

In the present invention, it is also preferable that a predetermined number of nozzle arrays from among the plurality of nozzle arrays discharges ink of different colors.

When variation exists among the drive circuits of an ink jet recording apparatus for performing so-called color printing, in which a predetermined number of the plurality of nozzle arrays discharges ink of different colors, banding may occur in each color. For example, when banding occurs in an ink jet recording apparatus which performs printing using ink of four colors, yellow, magenta, cyan, and black, the banding is not noticeable in the printing area printed in yellow, but is noticeable in the printing area printed in black, and hence the printing quality of the entire printing area decreases.

However, by applying the present invention to such an ink jet recording apparatus for performing color printing, the banding can be made unnoticeable, and hence the recording quality can be improved.

BRIEF DESCRIPTION OF THE DRAWINGS

FIG. 6 is a view illustrating connection combinations between the driver ICs and actuators;

FIG. 10 is a view illustrating connection combinations between the driver ICs and actuators in the first other embodiment;

FIG. 12 is a view illustrating connection combinations between the driver ICs and actuators in the second other embodiment;

FIG. 14 is a view illustrating connection combinations between the driver ICs and actuators in the third other embodiment;

DESCRIPTION OF THE PREFERRED EMBODIMENTS

Figure 1:
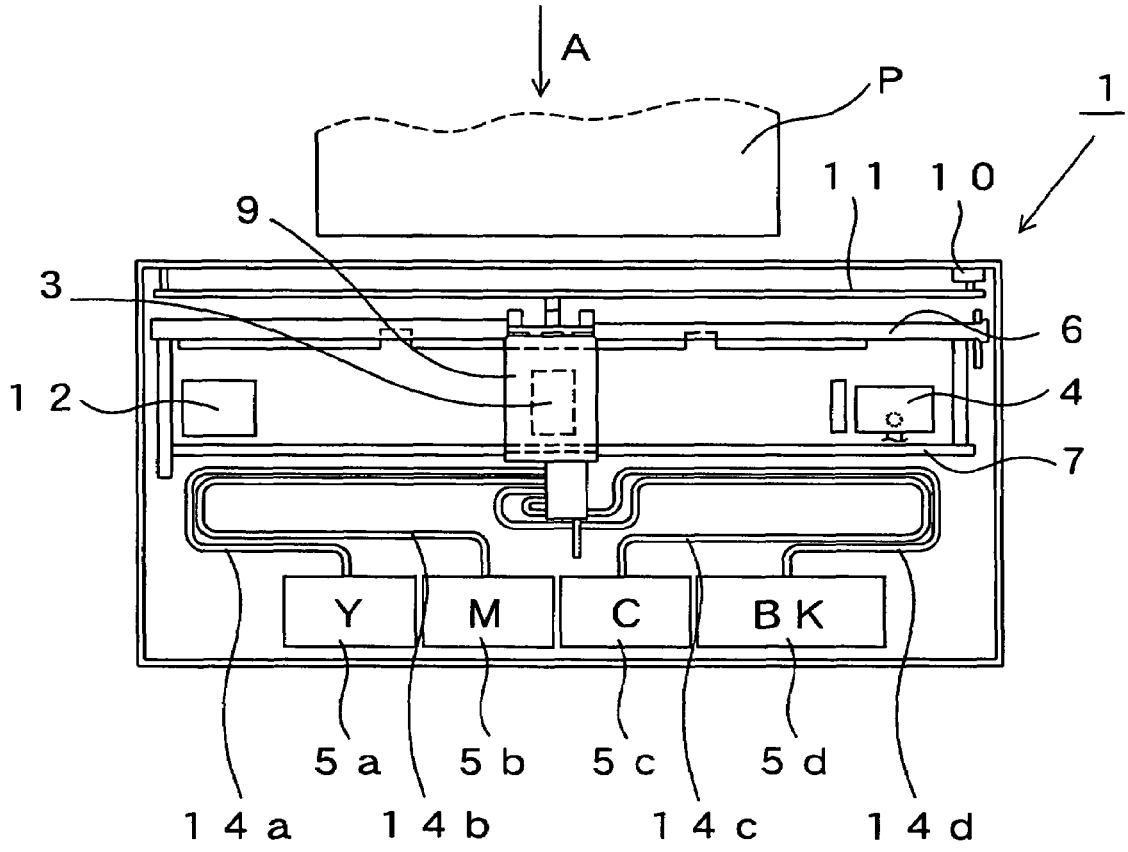
FIG. 1 is a plan view illustrating an ink jet recording apparatus according to a preferred embodiment of the present invention.
Figure 2:
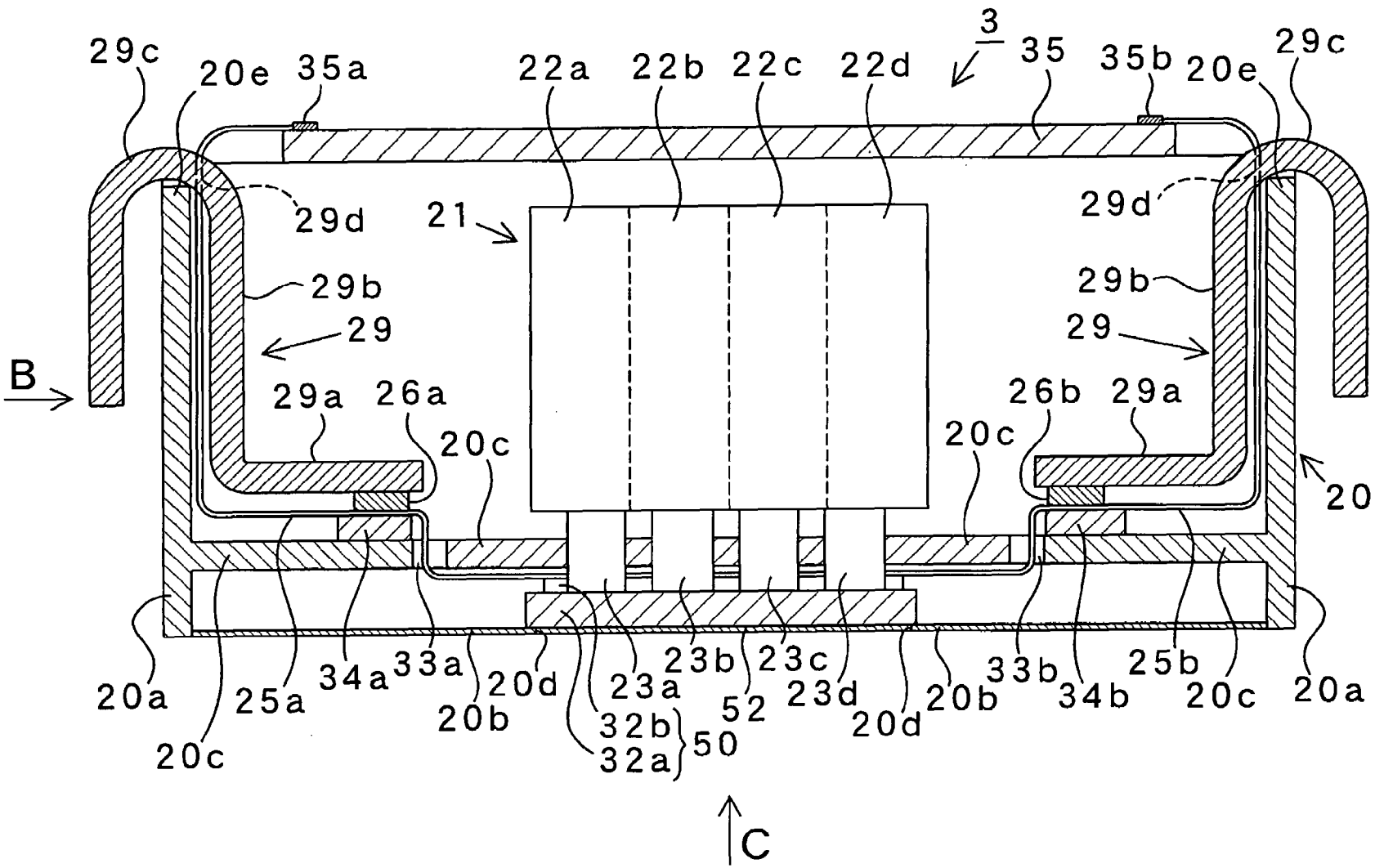
FIG. 2 is a longitudinal sectional view illustrating an ink jet head provided in the ink jet recording apparatus shown in FIG. 1.
Figure 3:
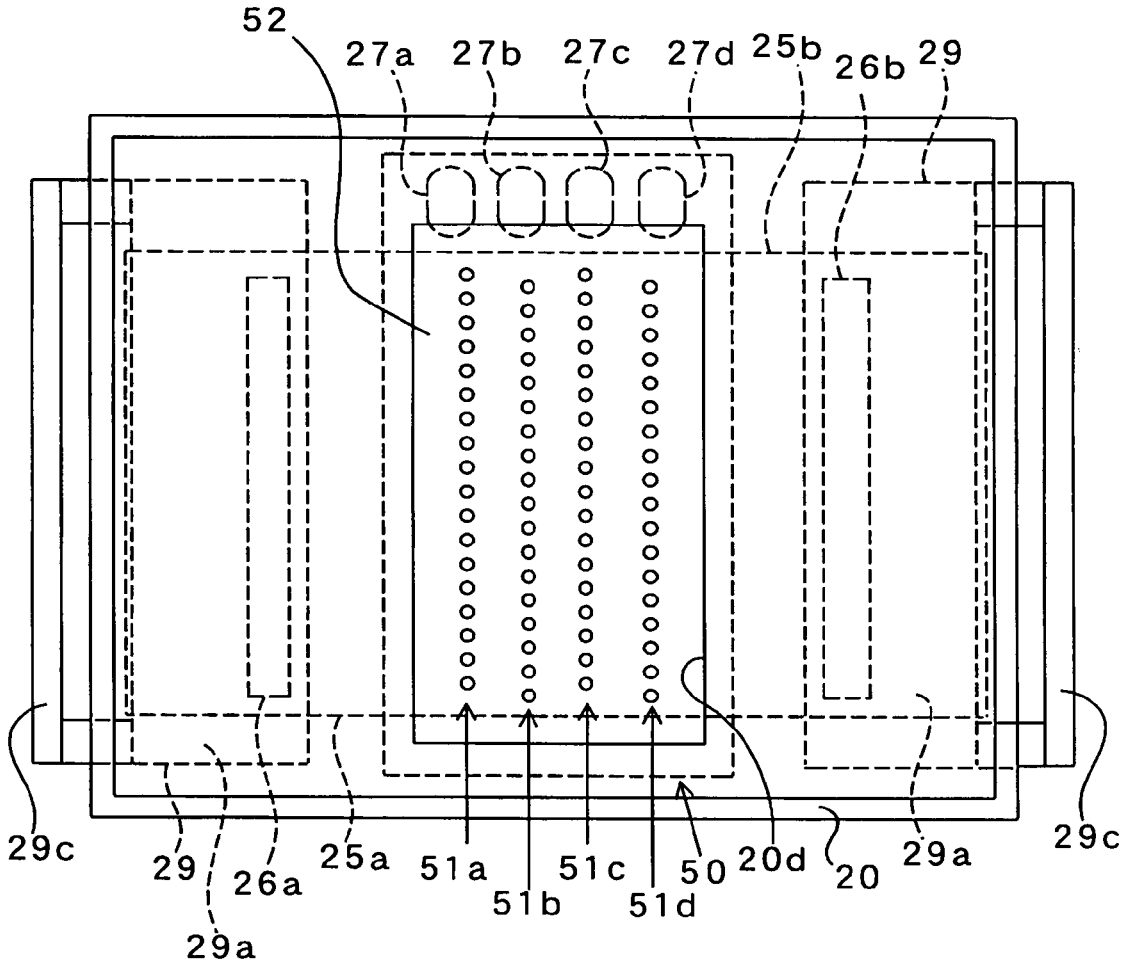
FIG. 3 is a plan view illustrating the ink jet head shown in FIG. 2 from a nozzle face (a direction shown by an arrow C in FIG. 2)
Figure 4:
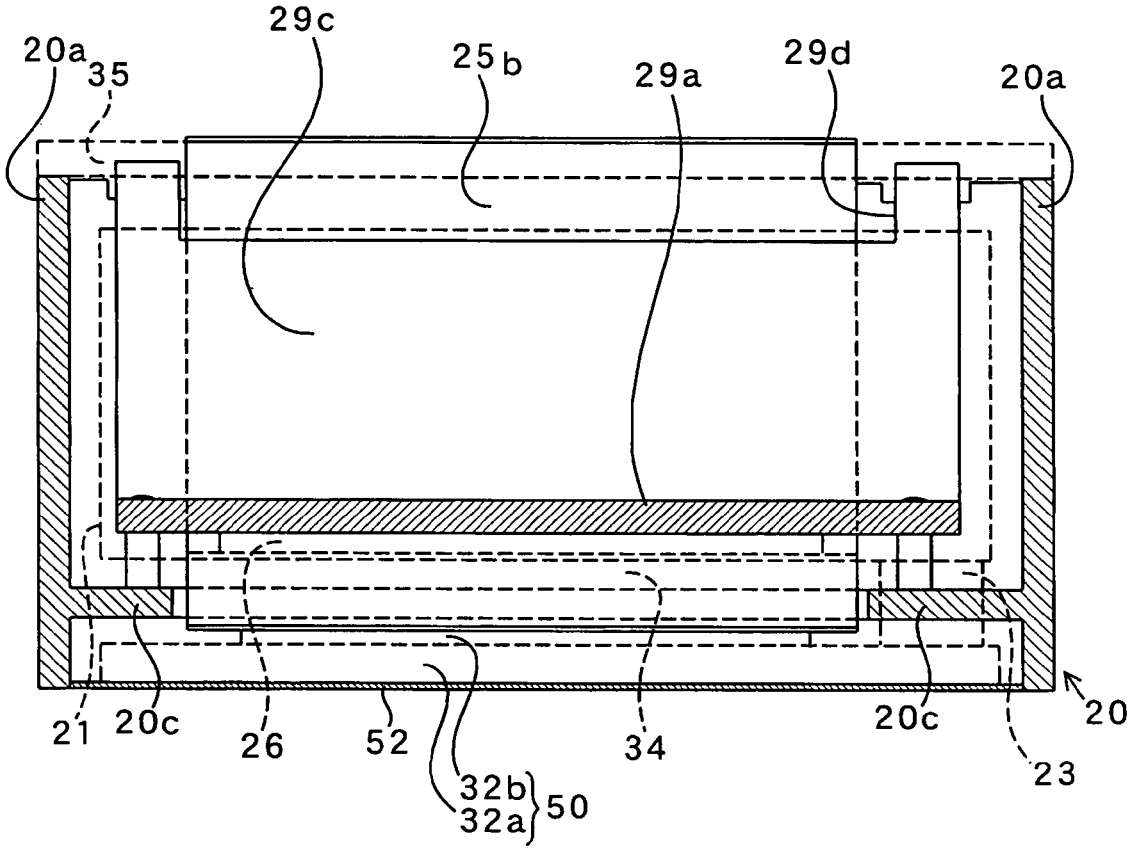
FIG. 4 is a plan view illustrating the ink jet head shown in FIG. 2 from a side face of a head holder 20 (a direction shown by an arrow B in FIG. 2)
Figure 5:
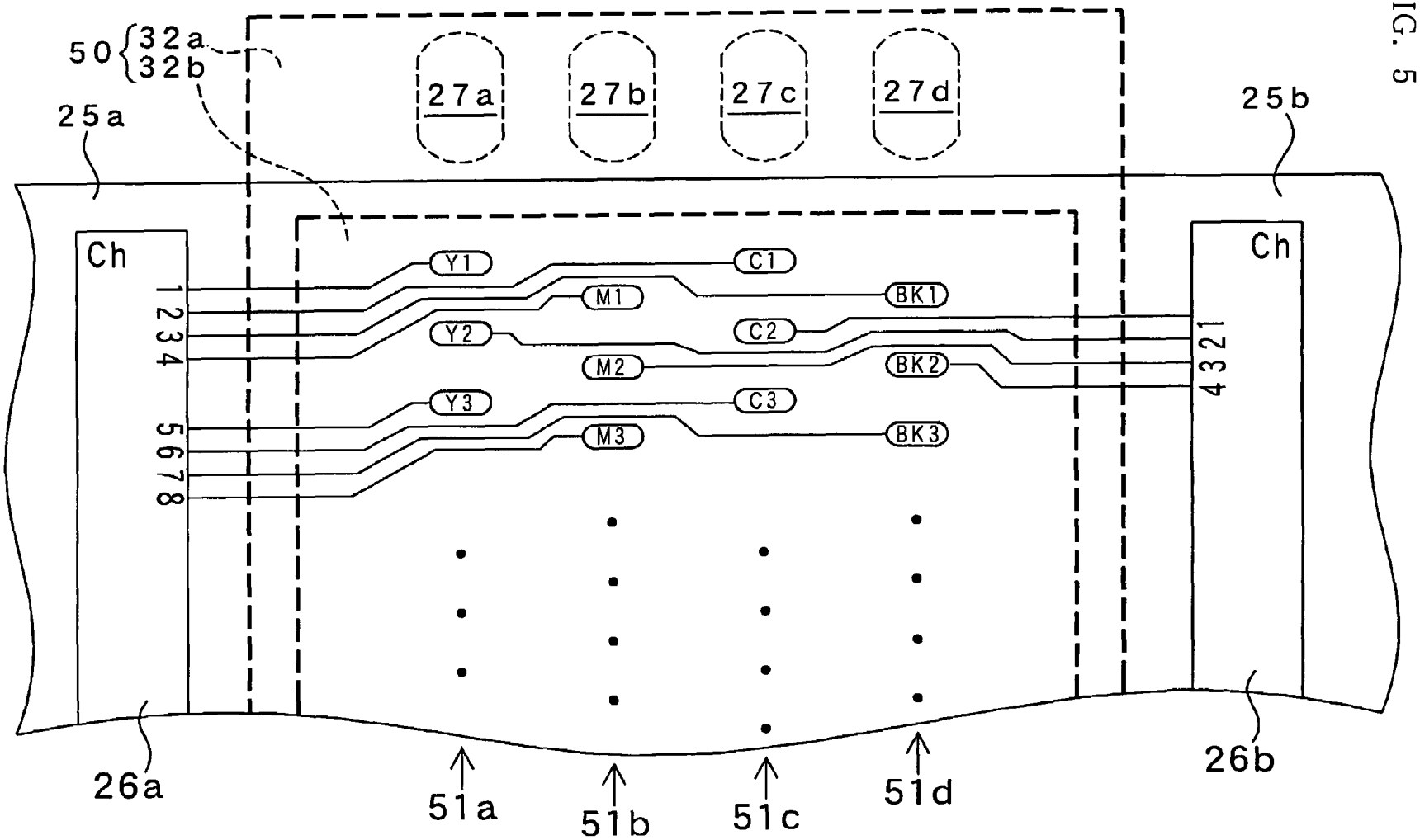
FIG. 5 is a view illustrating a method of connecting driver ICs and actuators.
Figure 7:
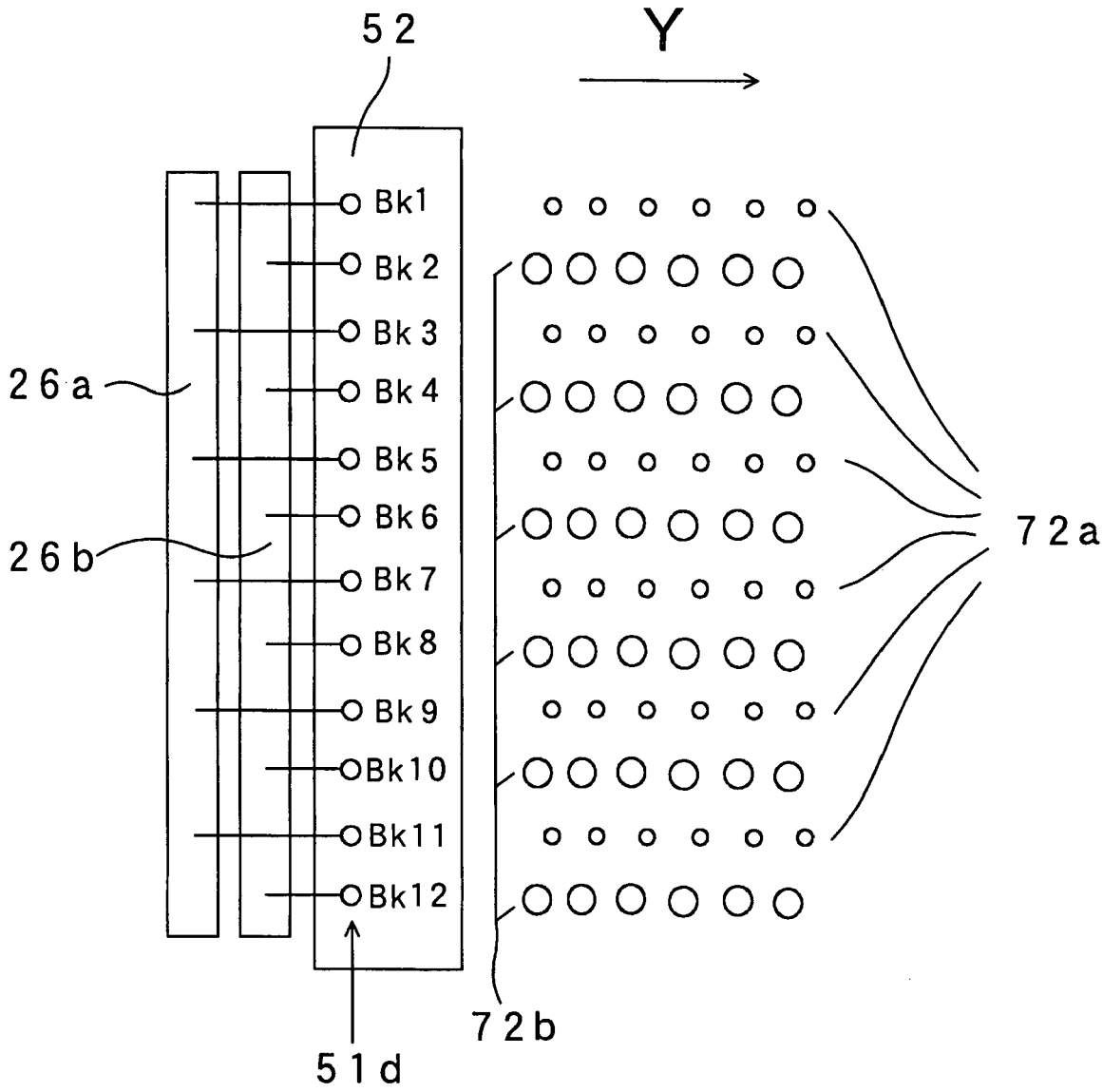
FIG. 7 is a schematic view illustrating a printing condition produced by the preferred embodiment of the present invention.

A preferred embodiment of the present invention will be described with reference to FIGS. 1 to 7. FIG. 1 is a plan view illustrating an ink jet recording apparatus according to the preferred embodiment of the present invention. FIG. 2 is a longitudinal sectional view illustrating an ink jet head provided in the ink jet recording apparatus shown in FIG. 1. FIG. 3 is a plan view illustrating the ink jet head shown in FIG. 2 from a nozzle face (a direction shown by an arrow C in FIG. 2). FIG. 4 is a plan view illustrating the ink jet head shown in FIG. 2 from a side face of a head holder 20 (a direction shown by an arrow B in FIG. 2). FIG. 5 is a view illustrating a method of connecting driver ICs and actuators. FIG. 6 is a view illustrating connection combinations between the driver ICs and actuators. FIG. 7 is a schematic view illustrating a printing condition produced by the preferred embodiment of the present invention.

Main Constitution of Ink Jet Recording Apparatus

As shown in FIG. 1, two guide shafts 6, 7 are provided in the interior of an ink jet recording apparatus 1, and a carriage 9 is mounted on the guide shafts 6, 7 so as to be capable of movement along the guide shafts 6, 7. An ink jet head 3 for performing recording by discharging ink onto recording paper P is mounted detachably onto the carriage 9. The recording paper P is conveyed in a direction shown by an arrow A in FIG. 1 by a conveyance device not shown in the drawing. The carriage 9 is mounted on an endless belt 11 that is rotated by a motor 10, and according to drive of the motor 10, the carriage 9 performs a reciprocating motion along the guide shafts 6, 7 in an orthogonal direction to the conveyance direction. When recording is performed on the recording paper P, the conveyance of the recording paper P and the reciprocating motion of the carriage 9 are performed in conjunction.

The ink jet recording apparatus 1 further comprises an ink tank 5*a* storing yellow ink, an ink tank 5*b* storing magenta ink, an ink tank 5*c* storing cyan ink, and an ink tank 5*d* storing black ink. The ink tanks 5*a* to 5*d* are connected to the ink jet head 3 by flexible ink supply tubes 14*a*, 14*b*, 14*c*, 14*d*, respectively. The ink of each color used in the ink jet head 3 is supplied through the ink supply tubes from each ink tank.

A flushing portion 12 is provided at one end of the movement direction of the carriage 9, and a maintenance portion 4 is provided at the other end. The ink jet head 3 discharges defective ink containing air bubbles or the like to the flushing portion 12 in order to maintain a favorable ink discharge performance. The maintenance portion 4 aspirates ink containing air bubbles, wipes the nozzle face, and so on in order to maintain a favorable ink discharge performance.

Main Constitution of Ink Jet Head

Next, the main constitution of the ink jet head 3 will be described. Note that in the illustration in FIG. 2, a head main body 50 is mounted in a downward direction.

As shown in FIG. 2, the head holder 20 is formed in a box-form from a side face portion 20*a* constituted by a plate-form member, and a bottom face portion 20*b* formed with a substantially square-shaped opening portion 20*d* (FIG. 3). A dividing member 20*c* is provided in the interior of the box for dividing the interior space into upper and lower portions. The head main body 50 is mounted in the opening portion 20*d* of the bottom face portion 20*b* facing downward so that a nozzle face 52 is exposed.

A buffer tank 21 for storing the ink that is supplied to the head main body 50 is mounted on the upper portion of the head main body 50 via ink supply members 23*a* to 23*d*.

From left to right in the drawing, the buffer tank 21 is provided with a yellow ink buffer chamber 22*a* storing yellow ink, a magenta ink buffer chamber 22*b* storing magenta ink, a cyan ink buffer chamber 22*c* storing cyan ink, and a black ink buffer chamber 22*d* storing black ink. When the head main body 50 discharges ink such that the ink is expended, negative pressure is generated in the buffer chambers, and thus the ink in the ink tanks 5*a* to 5*d* (see FIG. 1) is supplied to the buffer tank 21, and then supplied to the head main body 50 through the ink supply members 23*a* to 23*d*.

Further, a predetermined amount of air is stored in the interior of the buffer tank 21. This air alleviates the impulsive force which accompanies the movement and stoppage of the ink jet head 3 and prevents variation in the internal pressure of the pressure chambers of the head main body 50, thereby serving to maintain an even discharge performance in each of the nozzles.

As shown in FIG. 3, the head main body 50 takes a rectangular form, and the nozzle face 52 is provided with a yellow ink nozzle array 51*a*, a magenta ink nozzle array 51*b*, a cyan ink nozzle array 51*c*, and a black ink nozzle array 51*d* in succession from the left side of the drawing. The nozzle arrays 51*a* to 51*d* are formed in series, parallel to the conveyance direction of the recording paper P. Further, a yellow ink supply port 27*a*, a magenta ink supply port 27*b*, a cyan ink supply port 27*c*, and a black ink supply port 27*d*, each having an elliptical opening portion for supplying ink to the nozzles, are provided at the upstream side of the ink supply in the vicinity of the nozzle at the end portion of each nozzle array so as to correspond respectively to the ink supply members 23*a* to 23*d*. As shown in FIG. 2, the head main body 50 further comprises a passage member 32*a* comprising the nozzle face 52 on which the nozzles are formed and the elliptical ink supply ports 27*a* to 27*d*, and a piezoelectric actuator 32*b* constituted by a piezoelectric element. Ink passages for distributing ink from the ink supply ports 27*a* to 27*d* to the respective corresponding nozzles are formed in the interior of the passage member 32*a*.

Further, the piezoelectric actuator 32*b* (see FIG. 2) is provided on the rear surface of the nozzle face 52 of the head main body 50 in a position corresponding to the nozzle arrays 51*a* to 51*d*, and connected electrically to flexible flat cables 25*a*, 25*b* which are wider than the array length of the nozzle arrays 51*a* to 51*d*. The flat cable 25*a* and the flat cable 25*b* extend in opposite directions, and a driver IC 26*a* and a driver IC 26*b* formed in prismatic form, having a longitudinal direction in the arrangement direction of the nozzle arrays, and shorter than the width of the flat cables, are disposed respectively on the side of the head main body 50.

As shown in FIG. 2, the flat cable 25*a* and the flat cable 25*b* are inserted respectively into slits 33*a*, 33*b* formed in the dividing member 20*c* in the arrangement direction of the nozzle arrays 51*a* to 51*d*.

Plates 34*a*, 34*b* are provided on the dividing member 20*c* adjacent to the slits 33*a*, 33*b* respectively, and the driver ICs 26*a*, 26*b* are placed respectively on the upper face of the plates 34*a*, 34*b* via the flat cables 25*a*, 25*b*. The plates 34*a*, 34*b* are constituted by elastic members, and apply pressure to the driver ICs 26*a*, 26*b*. In this embodiment, the plates 34*a*, 34*b* are formed from silicone rubber.

Heat sinks 29, 29 serving as heat radiation members for radiating heat generated by the driver ICs 26*a*, 26*b* are mounted on the upper face of the driver ICs 26*a*, 26*b*, respectively. Each heat sink 29 is constituted by a contact portion 29*a*, a side face portion 29*b*, and a U-shaped portion 29*c*. Each contact portion 29*a* is formed in a horizontally long plate-form comprising a lower face which contacts the upper face of the driver IC. This lower face is formed with a considerably larger surface area than the upper face of the driver ICs 26*a*, 26*b*.

The driver ICs 26*a*, 26*b* are pushed against the contact portions 29*a* by the respective plates 34. As a result, the driver ICs 26*a*, 26*b* and contact portions 29*a* are in close contact, thereby improving conduction of the heat generated by the driver ICs 26*a*, 26*b* to the heat sinks 29, and increasing the radiation efficiency of the heat sinks 29.

The side face portions 29*b* rise upward in a vertical direction from the end portion of the contact portion 29*a*, from among the two end portions in the transverse direction thereof, on the side of the side face portion 20*a* of the head holder 20. The horizontally long plate face of the side face portions 29*b* is disposed parallel to the inside surface of the head holder 20 with a gap therebetween. The side face portions 29*b* extend upward along the inside surface of the head holder 20 and pass over an upper end portion 20*e* of the head holder in a substantial reversed U-shape, thus forming the U-shaped portion 29*c* which extends so as to hang down on the outside of the head holder 20. An elongated hole-form through hole 29*d* is formed at the bent portion of the U-shaped portion 29*c* for inserting the flat cables.

The flat cable 25*a* that is connected to the driver IC 26*a* passes between the side face portion 29*b* and head holder 20, is inserted into the through hole 29*d* (FIG. 4), and then connected to a control circuit substrate 35 provided on top of the buffer tank 21. This connection is performed via a connector 35*a* provided on the control circuit substrate 35. The flat cable 25*b* is disposed similarly so as to be connected to the control circuit substrate 35 via a connector 35*b* (see FIG. 2).

Driver circuits having identical circuit constitutions are installed in the driver ICs 26*a*, 26*b* respectively for outputting a driving signal to drive the piezoelectric actuator 32*b*. The drive circuit outputs a driving signal based on print data, i.e. the information required for printing, to the piezoelectric actuator 32*b* upon receiving a control signal that is output from the control circuit substrate 35. Note that the print data are input from a high-order machine such as a personal computer, expanded into image data in the ink jet recording apparatus, and then input into the driver ICs 26*a*, 26*b*.

Method of Connecting Driver ICs to Actuators

Next, a method of connecting the channels of the driver ICs 26*a*, 26*b* to actuators corresponding to the nozzles of the four nozzle arrays provided respectively for each color will be described.

As shown in FIG. 5, the input terminals of the actuators corresponding to the nozzles of the nozzle array 51*a* for yellow ink are named Y1, Y2, Y3 . . . in succession from the yellow ink supply port 27*a*. Similarly, the actuators corresponding to the nozzles of the nozzle array 51*b* for magenta ink are named M1, M2, M3 . . . in succession from the magenta ink supply port 27*b*, the actuators corresponding to the nozzles of the nozzle array 51*c* for cyan ink are named C1, C2, C3 . . . in succession from the cyan ink supply port 27*c*, and the actuators corresponding to the nozzles of the nozzle array 51*d* for black ink are named Bk1, Bk2, Bk3 . . . in succession from the black ink supply port 27*d*.

The channels of the driver IC 26*a* are provided in series parallel to the nozzle arrays, and are named a1, a2, a3 . . . in succession from the ink supply ports. Note that in the drawing, the symbol a is omitted, and only the numerals are illustrated. Similarly, the channels of the driver IC 26*b* are named b1, b2, b3 . . . in succession from the ink supply ports. Note that in the drawing, the symbol b is omitted, and only the numerals are illustrated.

In the yellow ink nozzle array 51*a*, the input terminal Y1 of the actuator is connected to the channel a1 and the actuator is driven by the driver IC 26*a*. The input terminal Y2 thereof is connected to the channel b1 and the actuator is driven by the driver IC 26*b*. The input terminal Y3 thereof is connected to the channel a5 and the actuator is driven by the driver IC 26*a*. Thus in the yellow ink nozzle array 51*a*, the odd-numbered input terminals and even-numbered input terminals of the actuators are driven by the driver IC 26*a* and the driver IC 26*b* respectively. Note that FIG. 5 shows a state in which the head main body 50, to which the flat cables 25*a*, 25*b* are connected, is seen from the flat cable side. Therefore, the input terminals of the actuators and the wires connecting the input terminals to the channels of the driver ICs 26*a*, 26*b* are invisible in reality, but for ease of description, are shown by solid lines here.

FIG. 6 shows the channels of the driver IC corresponding to combinations of the nozzle array, shown in the columns, and the number of the actuator input terminal, shown in the rows. Note that Y, M, C, and Bk correspond to the yellow ink nozzle array 51*a*, magenta ink nozzle array 51*b*, cyan ink nozzle array 51*c*, and black ink nozzle array 51*d*, respectively. For example, the third actuator input terminal C3 of the cyan ink nozzle array 51*c* is connected to the sixth channel a6 of the driver IC 26*a*.

The other nozzle arrays are constituted similarly to the yellow ink nozzle array 51*a* such that the odd-numbered actuators and even-numbered actuators are driven by the driver IC 26*a* and the driver IC 26*b*, respectively.

As shown in FIG. 5, the input terminals of the actuators connected to the driver IC 26*a* are constituted such that each channel is connected in succession to the input terminal of an actuator of a different color. Thus the channel a1 is connected to the input terminal Y1, the channel a2 is connected to the input terminal C1, the channel a3 is connected to the input terminal Bk1, and the channel a4 is connected to the input terminal M1. Subsequent channels are connected similarly according to this cycle of Y→C→Bk→M.

The driver IC 26*b* is also constituted such that each channel is connected in succession to the input terminal of an actuator of a different color. Thus the channel b1 is connected to the input terminal C2, the channel b2 is connected to the input terminal Y2, the channel b3 is connected to the input terminal M2, and the channel b4 is connected to the input terminal Bk2. Subsequent channels are connected similarly according to this cycle of C→Y→M→Bk.

By forming such connections, adjacent actuators in the same nozzle array are driven by different driver ICs connected alternately in staggered form, rather than by the same driver IC.

Structure and Operation of Driver IC

Figure 15:
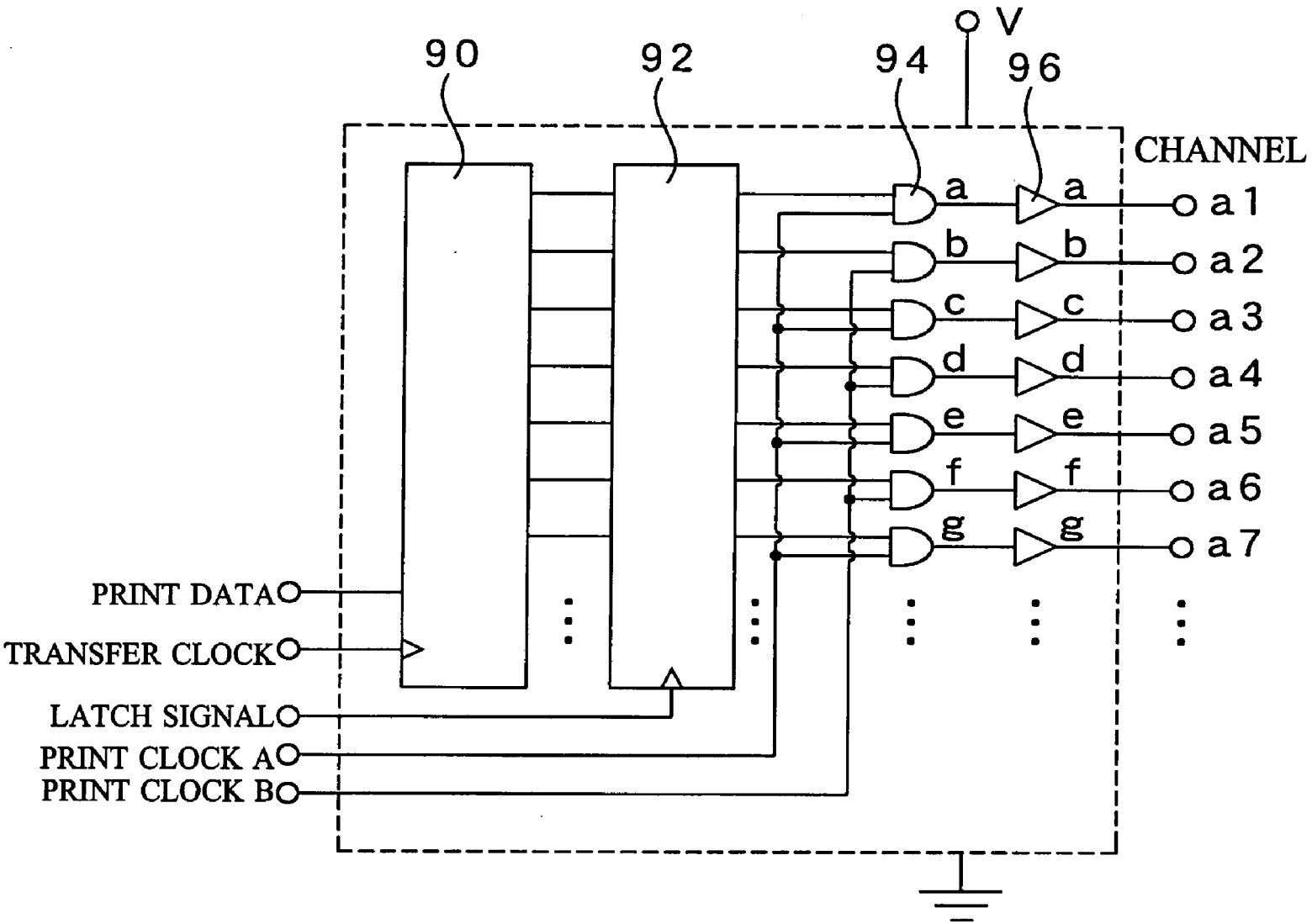
FIG. 15 is a schematic diagram showing the circuit constitution of the driver IC.

The driver IC 26*a* used in this embodiment has a schematic circuit constitution such as that shown in FIG. 15.

The driver IC 26*a* is constituted mainly by a conversion circuit 90 for converting print data input from a high-order machine from serial data to parallel data, and a latch circuit 92 for holding the data converted by the conversion circuit 90 temporarily. The driver IC 26*a* further comprises AND gates 94 for outputting the print data held in the latch circuit 92 at a predetermined timing, and amps 96 for providing a driving signal to the input terminal of the corresponding actuator on the basis of this output, and thereby driving the actuator.

These main portions, together with the AND gates 94 and amps 96, are provided on the same chip to form the driver IC 26*a*. The AND gates 94 and amps 96 are formed in connection with each channel, thereby constituting individual amp circuits corresponding to each nozzle.

As shown in FIG. 15, print data and a transfer clock are input into the conversion circuit 90. As described above, the print data are image data expanded in advance in the ink jet recording apparatus. The transfer clock is a clock signal instructing uptake of the print data into the conversion circuit 90. A latch signal is input into the latch circuit 92. The latch signal is a clock signal instructing uptake of the parallel data from the conversion circuit 90 into the latch circuit 92. In this embodiment, the AND gates 94 constituting the individual amp circuits are divided into two groups. Accordingly, a print clock A is input into the AND gates 94 (a, c, e, etc.) belonging to an A group, and a print clock B is input into the AND gates 94 (b, d, f, etc.) belonging to a B group, for example. Both of these print clocks are also clock signals instructing the respective AND gates 94 to output the print data held in the previous-stage latch circuit 92 to the subsequent-stage amp 96. The amps 96 (a, b, c, etc.) serve to power-amplify the signals output by the AND gates 94 (a, b, c, etc.), and therefore operate in synchronization with the output of the AND gates 94 (a, b, c, etc.). The amps 96 (a, b, c, etc.) output driving signals based on the print data output by the corresponding AND gates 94 (a, b, c, etc.) to the corresponding channels. Note that the transfer clock, latch signal, and print clocks input into the driver IC 26*a* are generated in the ink jet recording apparatus.

Figure 16:
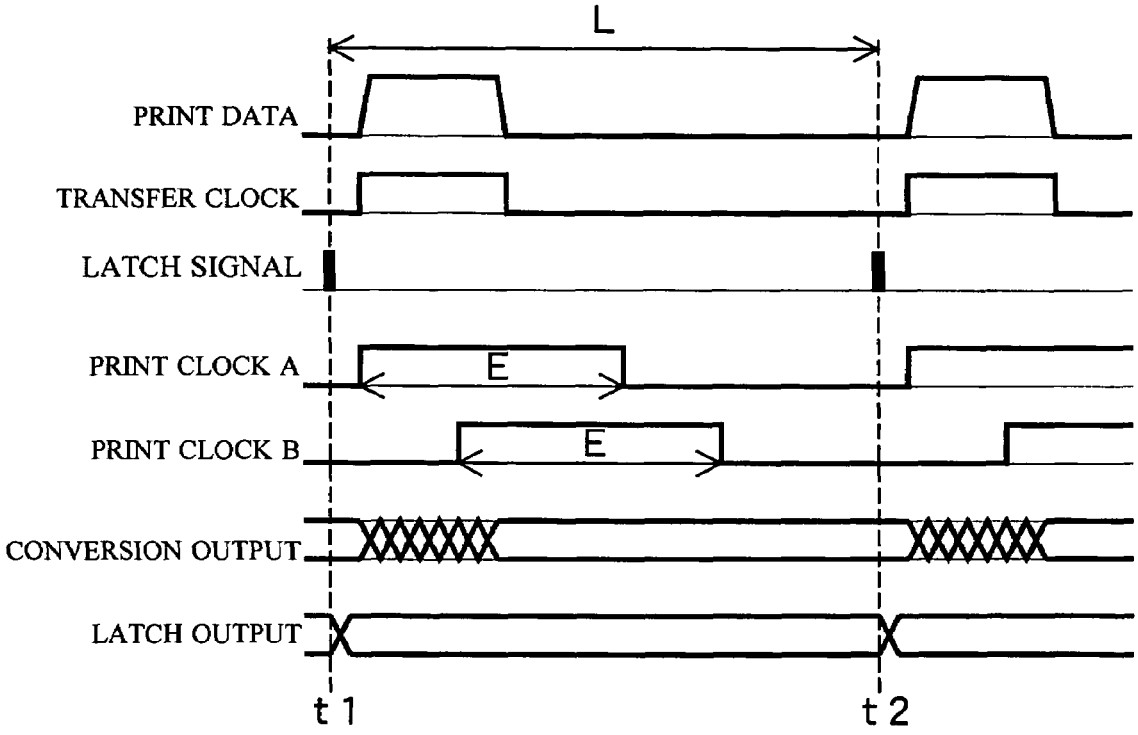
FIG. 16 is a timing chart showing an operation of the driver IC.

FIG. 16 shows a timing chart for an operation of the driver IC 26*a*. In this timing chart, the period from a time t1 to a time t2 corresponds to one print cycle L. The print data input in the initial stage of the print cycle are transferred in synchronization with the transfer clock, and taken into the conversion circuit 90 in succession. In the conversion circuit 90, print data taken in previously are rewritten in sequence by the print data to be taken in at this time. The latch signal is applied at the transition between print cycles L (t1, t2, etc.). Therefore, throughout the print cycle in which the conversion circuit 90 updates the data, the latch circuit 92 holds the print data updated by the conversion circuit 90 during the previous print cycle.

During this print cycle, the print clocks A, B are applied to the AND gates 94 in succession at a predetermined time difference. Both of the print clocks A, B are signals having a pulse width required for driving the actuators. Hence, if the print data held by the latch circuit 92 are data signifying that a certain actuator is to be driven, these print data are applied to the corresponding amp 96 via the corresponding AND gate 94 such that the individual amp circuit formed by the AND gate 94 and amp 96 becomes conductive, whereby a driving signal is output to the corresponding channel. If, on the other hand, the print data held by the latch circuit 92 are data signifying that a certain actuator is not to be driven, these print data are applied to the corresponding amp 96 via the corresponding AND gate 94 such that the corresponding individual amp circuit becomes non-conductive, and thus the corresponding actuator is not driven.

At this time, there is a predetermined time difference between the print clocks A, B, and hence the actuators corresponding to the respective groups are driven at an equal time difference. As a result, current flows at a different timing for each group such that the overall amount of current flowing simultaneously is reduced. This enables the current capacity required of the wires joining the actuators and driver ICs to be lowered, and also increases the design freedom of the circuits.

When each individual amp circuit becomes conductive, a driving signal is output to the actuator via the corresponding channel, but since the actuator also operates as a type of capacitor (condenser), a charging current and discharge current flow respectively at the start timing and end timing at which the driving signal is applied (the rise time and fall time). Each individual amp circuit also operates as the supply source of these currents. Furthermore, the individual amp circuits do not short-circuit when conductive, but in effect become resistors having a predetermined resistance value depending on the manufacturing method of the circuits (for example, an impurity diffusion method, an ion implantation method, or similar). Since the driver IC 26*a* is formed on one chip, this resistance is unique to the driver IC 26*a*, and hence, when an individual amp circuit becomes conductive, a current is supplied to the corresponding actuator via this unique resistance. The driver IC 26*a* used here comprises a plurality of individual amp circuits, but since these individual amp circuits are formed simultaneously on one chip, as described above, the respective resistance values thereof are in comparative alignment with each other. However, when this resistance value is compared with another driver IC, differences large enough to be recognized as discrepancies in the printing condition may occur due to variation in the manufacturing conditions, even when the manufacturing method is the same.

Note that the driver IC 26*b* used in this embodiment has the same circuit constitution as the driver IC 26*a*.

The printing condition obtained when these driver ICs 26*a*, 26*b* are combined to perform actual printing onto a recording medium will now be described.

Printing Condition

As shown in the pattern in FIG. 7, regarding the black ink nozzle array 51*d*, the odd-numbered actuators Bk1, Bk3 and so on of the actuators Bk1 to Bk12 are connected to the driver IC 26*a*, and the even-numbered actuators Bk2, Bk4 and so on are connected to the driver IC 26*b*.

Figure 8:
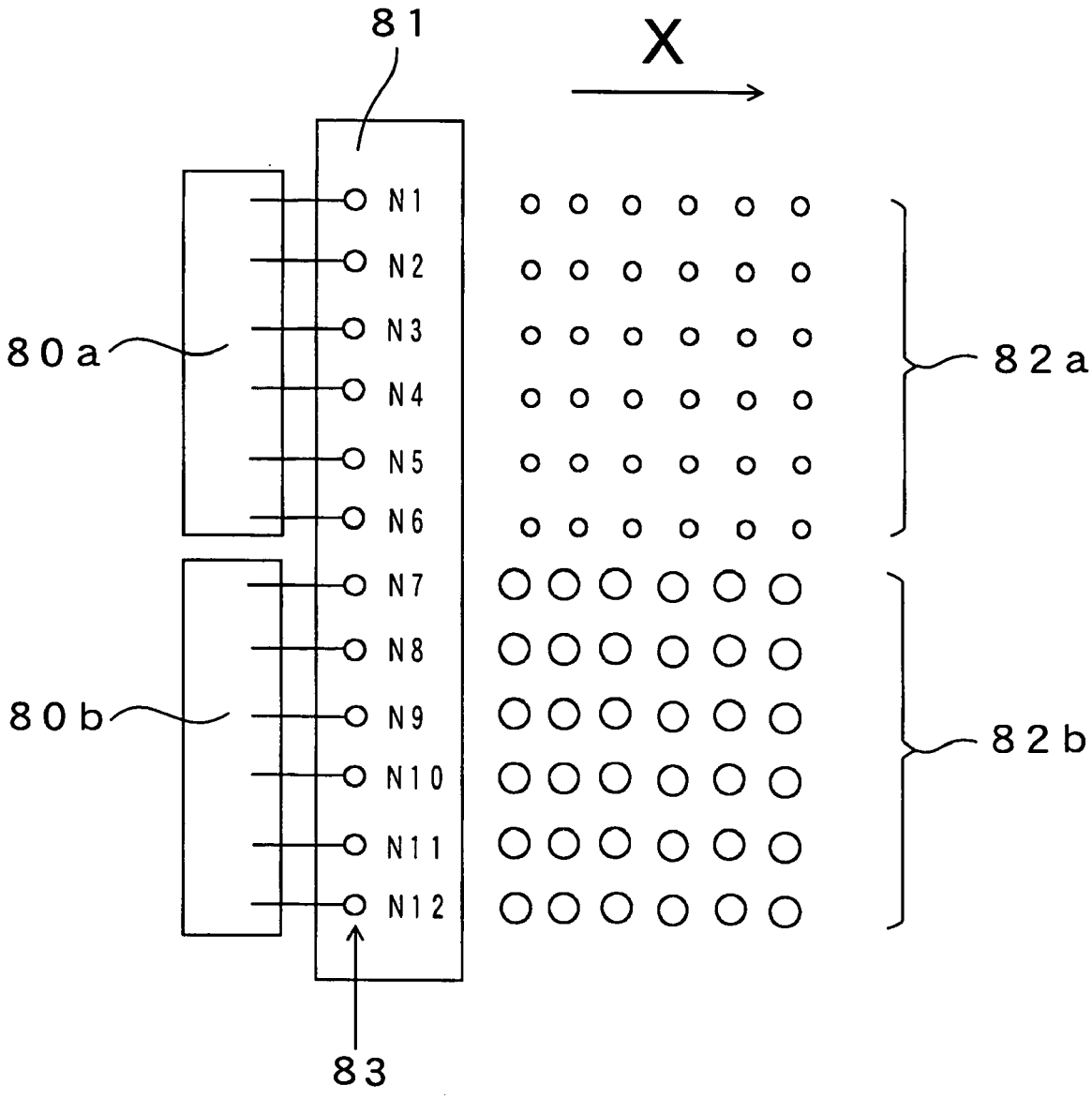
FIG. 8 is a schematic view illustrating a printing condition produced when the actuators are driven using two driver ICs having different output characteristics.

Similarly to the case shown in FIG. 8, printing is performed as the recording medium moves relative to the nozzle face 52 of the head main body 50 in a direction shown by an arrow Y in the drawing. The two driver ICs 26*a* and 26*b* have different output characteristics, and it is assumed that, according to these output characteristics, the driver IC 26*a* has a tendency toward small droplet volume and early discharge timing, whereas the driver IC 26*b* has a tendency toward large droplet volume and late discharge timing. These tendencies are due principally to differences in the unique resistance of the driver ICs 26*a*, 26*b*.

A dot array 72*a* is printed by the odd-numbered actuators driven by the driver IC 26*a*, and therefore comprises dots having a small dot diameter. A dot array 72*b* is printed by the even-numbered actuators driven by the driver IC 26*b*, and therefore comprises dots having a large dot diameter which are offset from the dot array 72*a* in the opposite direction to the arrow Y in the drawing. Accordingly, the dot array 72*a* has a low printing density and is printed palely, whereas the dot array 72*b* has a high printing density and is printed deeply. However, the dot array 72*a* and the dot array 72*b* appear alternately in an extremely narrow cycle of a one-dot print span when seen from an orthogonal direction to the movement direction of the recording medium. Therefore, as a whole it is almost impossible for the naked eye to recognize these cycles.

Note that printing deviation is a deviation in the printing position corresponding to differences in the discharge timing of the driver ICs 26*a*, 26*b*. Hence, when seen from the movement direction of the recording medium (the direction of the arrow Y), this offset is no more than a one dot interval, which is extremely small. Therefore, as a whole it is almost impossible for the naked eye to recognize the offset.

In other words, the degree of positional deviation caused by variation in the size of the individual ink droplets and the discharge timing does not vary, but since printing is performed by driving different driver ICs for every other actuator, differences in the halftones of each color and positional deviation vary in an extremely narrow cycle of a one-dot print span, which as a whole is almost unrecognizable to the naked eye.

Effects of the Preferred Embodiment (1) By using the ink jet recording apparatus of the preferred embodiment described above, the nozzle groups are divided by nozzle, or in other words by the smallest possible unit, and hence the print span of one group is as narrow as possible.

Accordingly, by using driver ICs having different output characteristics, for example, even if banding does occur at the parts corresponding to the boundaries between groups, it is impossible for the naked eye to recognize the existence of this banding, and therefore the recording quality can be improved. Moreover, the need to use expensive driver ICs having uniform output characteristics is eliminated.

Furthermore, the number of driver ICs can be suppressed to the minimum required number, i.e. two, enabling a reduction in the manufacturing cost of the ink jet recording apparatus.

(2) Further, banding is unnoticeable even in the printing area printed with black ink, and hence color printing can be performed with a high overall recording quality.

First other Embodiment

Figure 9:
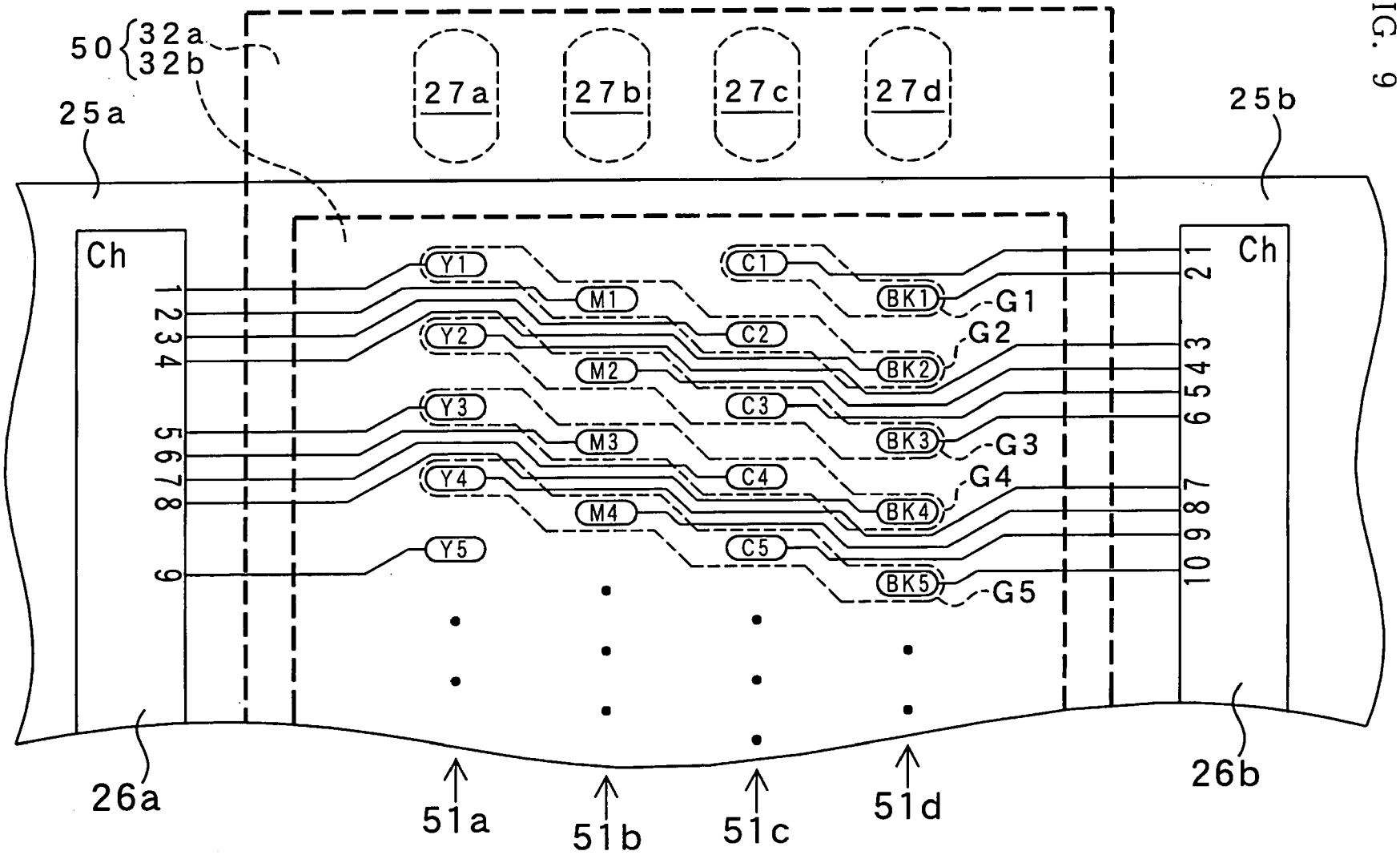
FIG. 9 is a view illustrating a method of connecting the driver ICs and actuators in a first other embodiment.

Next, a first other embodiment of the present invention will be described with reference to FIGS. 9 and 10. FIG. 9 is a view illustrating a method of connecting the driver ICs and actuators of the first other embodiment. FIG. 10 is a view illustrating connection combinations between the driver ICs and actuator in the first other embodiment.

Note that other than the method of connecting the driver ICs and actuators, this embodiment has an identical structure to the preferred embodiment described above, and hence description of identical parts has been omitted, and identical reference symbols are used for identical structures.

Method of Connecting Driver ICs and Actuators

It is assumed that four actuators corresponding to the respective colors form a group n. At this time, the input terminals Y (n-1), M (n-1), Cn, and Bkn corresponding to each actuator also form a group n in relation to the natural number n. When n=1, the input terminals of the actuators corresponding to Y (n-1) and M (n-1) do not exist, and therefore a group 1 (denoted as G1 in the drawing, likewise hereafter) is formed by the input terminal C1 and the input terminal Bk1.

As shown in FIG. 9, a group 2 is formed from the input terminals of actuators spanning two numbers, i.e. Y1, M1, C2, Bk2, and from a group 3 onward, similar groups are formed repeatedly.

As shown in FIG. 10, the driver IC 26*a* is constituted such that each channel is connected in succession to an actuator input terminal of a different color. Thus the channel a1 is connected to the input terminal Y1, the channel a2 is connected to the input terminal M1, the channel a3 is connected to the input terminal C2 and the channel a4 is connected to the input terminal Bk2. Subsequent channels are also connected according to this cycle of Y→M→C→Bk.

In the driver IC 26*b*, the channel b1 is connected to the input terminal C1 and the channel b2 is connected to the input terminal Bk1. The channel b3 and subsequent channels are connected similarly to the driver IC 26*a* to the actual input terminals of the different colors in succession, according to this cycle of Y→M→C→Bk.

In the yellow ink nozzle array 51*a* and magenta ink nozzle array 51*b*, the odd-numbered actuators are connected to the driver IC 26*a* and the even-numbered actuators are connected to the driver IC 26*b*. In the cyan ink nozzle array 51*c* and the black ink nozzle array 51*d*, the odd-numbered actuators are connected to the driver IC 26*b* and the even-numbered actuators are connected to the driver IC 26*a*.

In other words, the actuators belonging to the same group are disposed over two numbers, and the driver IC which drives the actuators is switched alternately in all of the nozzle arrays.

Effects of the First other Embodiment (1) By using the ink jet recording apparatus in the manner described above, the plurality of nozzles belonging to a group is constituted by nozzles which all belong to different nozzle arrays. In other words, each group is formed from nozzles existing in the arrangement direction of the nozzle arrays, and hence each group is formed in nozzle units in the nozzle arrangement direction. Further, the nozzles belonging to the same group are disposed over two numbers, and hence the printed dots produced by the nozzles belonging to that group are dispersed over a wider range.

Hence, even if banding occurs in the parts corresponding to the boundaries between the groups, the interval between the banding is no more than a nozzle unit, and it is therefore impossible to recognize the banding. As a result, a further improvement in recording quality can be achieved.

(2) Moreover, the first other embodiment is constituted identically to the ink jet recording apparatus of the preferred embodiment other than the method of connecting the driver ICs and actuators, and therefore the aforementioned effect (2) of the preferred embodiment can also be achieved.

Second other Embodiment

Figure 11:
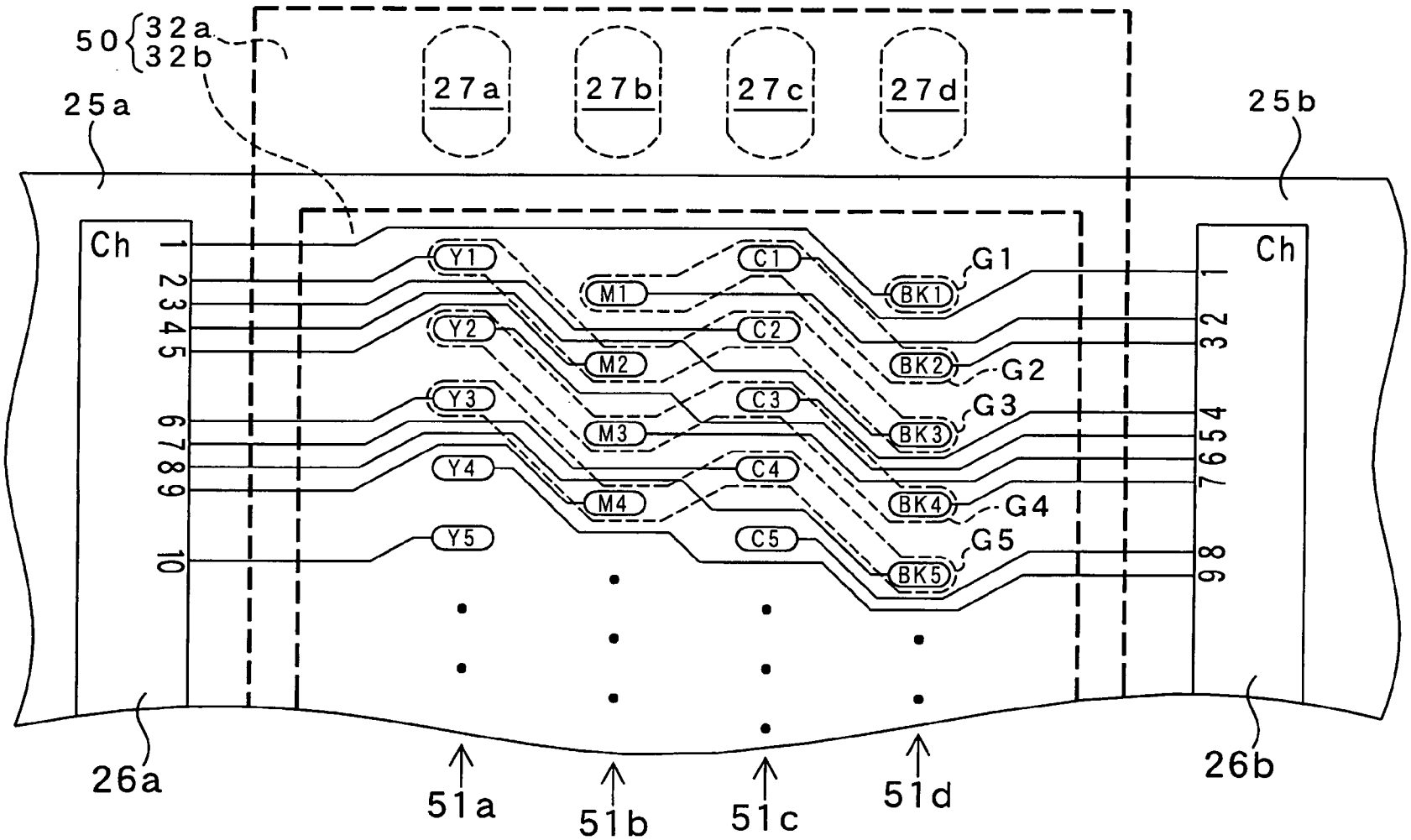
FIG. 11 is a view illustrating a method of connecting the driver ICs and actuators in a second other embodiment.

Next, a second other embodiment of the present invention will be described with reference to FIGS. 11 and 12. FIG. 11 is a view illustrating a method of connecting the driver ICs and actuators of this embodiment. FIG. 12 is a view illustrating connection combinations between the driver ICs and actuators of this embodiment.

Note that other than the method of connecting the driver ICs and actuators, this embodiment has an identical structure to the preferred embodiment described above, and hence description of identical parts has been omitted, and identical reference symbols are used for identical structures.

Method of Connecting Driver ICs and Actuators

Similarly to the first other embodiment described above, it is assumed that four input terminals Y (n-2), M (n-1), C (n-1), and Bkn form a group n in relation to the natural number n. When n=1, the input terminals of the actuators corresponding to Y (n-2), M (n-1), and C (n-1) do not exist, and therefore a group 1 (denoted as G1 in the drawing, likewise hereafter) is formed by the input terminal Bk1 alone. When n=2, a group 2 is formed by the input terminals M1, C1, and Bk2.

As shown in FIG. 11, a group 3 is formed from the input terminals of actuators spanning three numbers, i.e. Y1, M2, C2, Bk3, and from a group 4 onward, similar groups are formed repeatedly.

As shown in FIG. 12, the driver IC 26*a* is constituted such that the channel a1 is connected to the input terminal Bk1 of the actuator which discharges black ink, and the channels a2 onward are connected in succession to the input terminals of actuators of different colors according to this cycle of Y→C→Bk→M.

The driver IC 26*b* is constituted such that the channel b1 is connected to the input terminal C1, the channel b2 is connected to the input terminal M1, the channel b3 is connected to the input terminal Bk1, and the channel b4 and subsequent channels are connected in succession to input terminals corresponding to actuators of different colors according to this cycle of C→Y→M→Bk.

In the yellow ink nozzle array 51*a* and black ink nozzle array 51*d*, the odd-numbered actuators are connected to the driver IC 26*a* and the even-numbered actuators are connected to the driver IC 26*b*. In the magenta ink nozzle array 51*b* and the cyan ink nozzle array 51*c*, the odd-numbered actuators are connected to the driver IC 26*b* and the even-numbered actuators are connected to the driver IC 26*a*.

In other words, the actuators belonging to the same group are disposed over three numbers, and the driver IC which drives the actuators is switched alternately in all of the nozzle arrays.

Effects of the Second other Embodiment (1) By using the ink jet recording apparatus in the manner described above, the plurality of nozzles belonging to a group is constituted by nozzles which all belong to different nozzle arrays. In other words, each group is formed from nozzles existing in the arrangement direction of the nozzle arrays, and hence each group is formed in nozzle units in the nozzle arrangement direction. Further, the nozzles belonging to the same group are disposed over three numbers, and hence the printed dots produced by the nozzles belonging to that group are dispersed over a wider range.

Hence, even if banding occurs in the parts corresponding to the boundaries between the groups, the interval between the banding is no more than a nozzle unit, and it is therefore impossible to recognize the banding. As a result, a further improvement in recording quality can be achieved.

(2) Moreover, the second other embodiment is constituted identically to the ink jet recording apparatus of the preferred embodiment other than the method of connecting the driver ICs and actuators, and therefore the aforementioned effect (2) of the preferred embodiment can also be achieved.

Third other Embodiment

Figure 13:
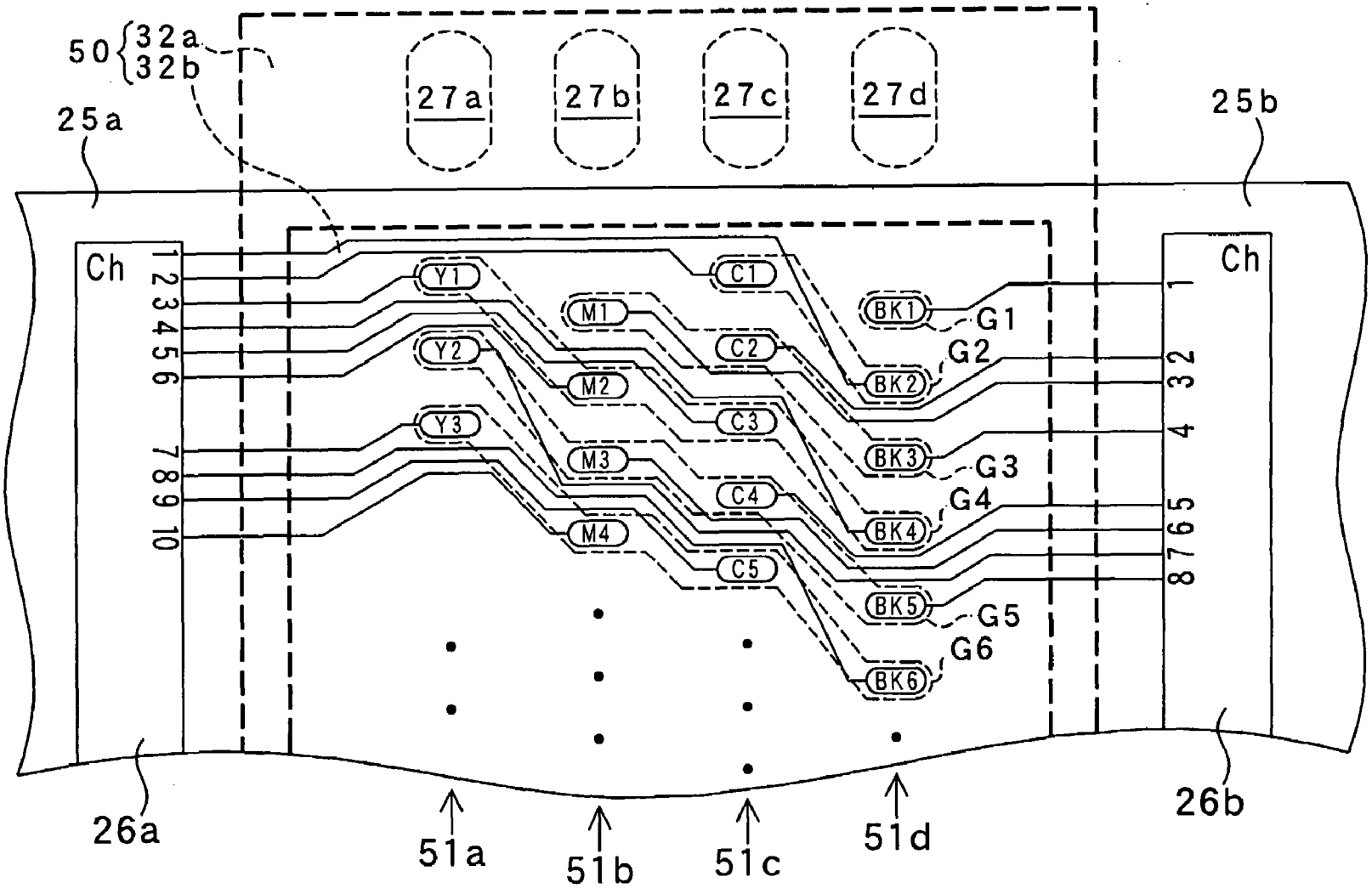
FIG. 13 is a view illustrating a method of connecting the driver ICs and actuators in a third other embodiment.

Next, a third other embodiment of the present invention will be described with reference to FIGS. 13 and 14. FIG. 13 is a view illustrating a method of connecting the driver ICs and actuators of this embodiment. FIG. 14 is a view illustrating connection combinations between the driver ICs and actuators of this embodiment.

Note that other than the method of connecting the driver ICs and actuators, this embodiment has an identical structure to the preferred embodiment described above, and hence description of identical parts has been omitted, and identical reference symbols are used for identical structures.

Method of Connecting Driver ICs and Actuators

Similarly to the first other embodiment described above, it is assumed that four input terminals Y (n-3), M (n-2), C (n-1), and Bkn form a group n in relation to the natural number n. When n=1, the input terminals of the actuators corresponding to Y (n-3), M (n-2), and C (n-1) do not exist, and therefore a group 1 (denoted as G1 in the drawing, likewise hereafter) is formed only by the input terminal Bk1 of the actuator for discharging black ink. When n=2, a group 2 is formed by the input terminals C1 and Bk2. When n=3, a group 3* is formed by the input terminals M1, C2, and Bk3.

As shown in FIG. 13, a group 4 is formed from the input terminals of actuators spanning four numbers, i.e. Y1, M2, C3, Bk4, and from a group 5 onward, similar groups are formed repeatedly.

As shown in FIG. 14, the input terminals of the actuators connected to the driver IC 26*a* are constituted such that the channel a1 is connected to the input terminal Bk2, the channel a2 is connected to the input terminal C1, and the channels a3 onward are connected in succession to the input terminals of actuators of different colors according to this cycle of Y→Bk→C→M.

The actuators connected to the driver IC 26*b* are constituted such that the channel b1 is connected to the input terminal Bk1, the channel b2 is connected to the input terminal C2, the channel b3 is connected to the input terminal M1, and the channel b4 is connected to the input terminal Bk3. The channel b5 and subsequent channels are connected in succession to the input terminals of actuators of different colors according to this cycle of C→M→Y→Bk.

In the yellow ink nozzle array 51*a* and cyan ink nozzle array 51*c*, the odd-numbered actuators are connected to the driver IC 26*a* and the even-numbered actuators are connected to the driver IC 26*b*. In the magenta ink nozzle array 51*b* and the black ink nozzle array 51*d*, the odd-numbered actuators are connected to the driver IC 26*b* and the even-numbered actuators are connected to the driver IC 26*a*.

In other words, the actuators belonging to the same group are disposed over four numbers, and the driver IC which drives the actuators is switched alternately in all of the nozzle arrays.

Effects of the Third other Embodiment (1) By using the ink jet recording apparatus in the manner described above, the nozzle groups are constituted such that the plurality of nozzles are distributed over the arrangement direction of the nozzles and a direction which intersects the arrangement direction, and hence the printing area printed by the nozzles within a group can be dispersed over the arrangement direction of the nozzles and a direction intersecting the arrangement direction. In other words, nozzles belonging to the same group exist neither in the arrangement direction of the nozzles nor in a direction intersecting the arrangement direction.

Hence, even if banding occurs in the parts corresponding to the boundaries between the groups, the banding is not formed in a linear fashion, and it is therefore difficult to recognize the existence of the banding. As a result, a further improvement in recording quality can be achieved.

(2) Moreover, the third other embodiment is constituted identically to the ink jet recording apparatus of the preferred embodiment other than the method of connecting the driver ICs and actuators, and therefore the aforementioned effect (2) of the preferred embodiment can also be achieved.

Other Embodiments (1) The number of nozzles from the same nozzle array which belong to the same group may be set at a predetermined number unit of two or more. When this constitution is employed, the nozzle groups are distributed according to the predetermined nozzle number unit, and therefore the boundaries between groups can be set at equal intervals. Hence, even when banding occurs in the parts corresponding to the boundaries, the banding occurs at equal intervals, and therefore noticeable banding caused by partially wide intervals does not occur.

(2) The plurality of nozzles may be divided into a larger number of groups (three or more, for example) than the number of driver ICs. For example, the number of nozzles belonging to a single group may be set to or below the number of nozzle arrays (for example, four nozzles or less when there are four nozzle arrays). When this constitution is employed, the plurality of nozzles can be divided into an extremely large number of groups, and hence the intervals of the banding that occurs in the parts corresponding to the boundaries between groups can be made extremely narrow, thereby enabling the same effects as those of the embodiments described above to be achieved.

(3) The number of driver ICs may be set at three or more. When this constitution is employed, the number of nozzles in each group driven by the same driver IC is lower than that of a case in which the nozzle arrays are divided according to the number of driver ICs, and hence the print span becomes narrower. As a result, even when irregularities occur in the droplet volume or ink discharge timing due to differences in the output characteristics of the driver ICs of adjacent groups, the span of these parts is narrow, and therefore differences in the halftones of the colors, banding, and so on are not noticeable, enabling the same effects as those of the embodiments described above to be achieved.

(4) An ink jet recording apparatus comprising a head in which nozzle arrays are arranged in an orthogonal direction to the conveyance direction of the recording paper P may be used as the ink jet recording apparatus. When this constitution is employed, the nozzle arrays are still divided into groups, and therefore the same effects as those of the embodiments described above can be achieved.

(5) A fixed head-type ink jet recording apparatus, in which recording is performed by moving a recording medium relative to an actuator, may be used as the ink jet recording apparatus. When a fixed head is used, the relative movement between the head and recording medium is realized simply by conveying the recording medium. Accordingly, when a plurality of driver ICs is used in relation to the single head, the head itself does not move, and therefore printing defects such as banding caused by the specific connection condition between the nozzle arrays and driver ICs are likely to occur. However, by dividing the plurality of arrayed nozzles into a plurality of groups and connecting adjacent groups to different driver ICs, as described above, the same effects as those of the embodiments described above can be achieved.

(6) Electrothermal transducing elements, for example, may be used instead of piezoelectric actuators as the actuators. When this constitution is employed, adjacent groups are still connected to different driver ICs, and therefore the same effects as those of the embodiments described above can be achieved.

It is noted that in the present invention, the recording paper P corresponds to the recording medium, the piezoelectric actuator 32*b* corresponds to the actuators, and the driver ICs 26*a*, 26*b* correspond to the drive circuits.

The entire disclosure of the specification, claims, summary and drawings of Japanese Patent Application No. 2004-145118 filed on May 14, 2004 is hereby incorporated by reference.

What is claimed is:

1. An ink jet recording apparatus comprising:

a head main body having a nozzle array in which a plurality of nozzles for discharging ink onto a recording medium are arranged;

a plurality of actuators provided respectively for each of said nozzles, for discharging ink from said nozzles; and a plurality of drive circuits for outputting to said actuators a driving signal based on print data to cause ink to be discharged from said nozzles, wherein said drive circuits comprise a plurality of individual amp circuits connected individually to each of said actuators in order to switch said actuators between either one of a conductive state and a non-conductive state in accordance with said print data, whereby in said conductive state, said driving signal is outputted to said corresponding actuator via a unique individual resistance of said drive circuit, said plurality of nozzles is distributed among a greater number of groups than the number of said drive circuits, and from among adjacent groups, the actuators corresponding to the nozzles belonging to one of said adjacent groups connect to said individual amp circuits belonging to one of said drive circuits, and the actuators corresponding to the nozzles belonging to the other of said adjacent groups connect to said individual amp circuits belonging to another of said drive circuits.

2. The ink jet recording apparatus according to claim 1, wherein the nozzles of said nozzle array are distributed among said groups in a unit of the predetermined number of nozzle.

3. The ink jet recording apparatus according to claim 1, wherein the number of said drive circuits is two, and the nozzles of said nozzle array are distributed among said groups in a unit of the number of nozzle being one.

4. The ink jet recording apparatus according to claim 1, wherein a plurality of said nozzle arrays is provided, and a predetermined number of said plurality of nozzle arrays discharges ink of different colors.

5. An ink jet recording apparatus comprising:

a head main body comprising a plurality of nozzle arrays formed with a plurality of nozzles for discharging ink onto a conveyed recording medium, in which said plurality of nozzles are arranged in parallel;

a plurality of actuators provided respectively for each of said nozzles, for discharging ink from said nozzles; and a plurality of drive circuits for outputting a driving signal to said actuators to cause ink to be discharged from said nozzles, wherein said plurality of nozzles are distributed among a greater number of groups than the number of said drive circuits in at least an arrangement direction of said nozzles, and from among adjacent groups, the actuators corresponding to the nozzles belonging to one of said adjacent groups connect to one of said drive circuits, and the actuators corresponding to the nozzles belonging to the other of said adjacent groups connect to another of said drive circuits.

6. The ink jet recording apparatus according to claim 5, wherein the number of said plurality of nozzles belonging to each group is equal to or fewer than the number of said plurality of nozzle arrays.

7. The ink jet recording apparatus according to claim 5, wherein said plurality of nozzles belonging to each group is constituted of nozzles which all belong to different nozzle arrays.

8. The ink jet recording apparatus according to claim 5, wherein said groups are constituted such that said plurality of nozzles is distributed over said arrangement direction of said nozzles and a direction which intersects said arrangement direction.

9. The ink jet recording apparatus according to claim 5, comprising a carriage on which said head main body is mounted detachably, wherein said plurality of nozzles is arranged parallel to a conveyance direction of said recording medium, and said carriage performs a reciprocating motion in an orthogonal direction to said conveyance direction in accordance with said driving signal outputted to said actuator.

10. The ink jet recording apparatus according to claim 5, wherein said plurality of nozzles is arranged in an orthogonal direction to a conveyance direction of said recording medium, and said recording medium is conveyed in accordance with said driving signal.

11. The ink jet recording apparatus according to claim 5, wherein the number of said drive circuits for outputting said driving signal is two.

12. The ink jet recording apparatus according to claim 5, wherein a predetermined number of nozzle arrays from among said plurality of nozzle arrays discharges ink of different colors.

* * * * *